United States Patent [19]

Oquita

[11] 4,167,078

[45] Sep. 11, 1979

[54] PULL-PIN PINATA

[76] Inventor: Ramiro M. Oquita, 6014 Chandler Dr., San Diego, Calif. 92117

[21] Appl. No.: 873,804

[22] Filed: Jan. 31, 1978

Related U.S. Application Data

[63] Continuation-in-part of Ser. No. 758,215, Jan. 10, 1977, Pat. No. 4,092,798, which is a continuation-in-part of Ser. No. 617,602, Sep. 29, 1975, Pat. No. 4,015,364.

[51] Int. Cl.[2] ..... B65D 5/36; A63H 33/00

[52] U.S. Cl. ..... 46/11

[58] Field of Search ..... 46/11, 38; 229/8, 7 R; 220/260

[56] References Cited

U.S. PATENT DOCUMENTS

| | | | |
|---|---|---|---|
| 1,732,282 | 10/1929 | Sage | 229/7 R X |
| 3,702,675 | 11/1972 | Bajo | 46/11 |

FOREIGN PATENT DOCUMENTS

| | | | |
|---|---|---|---|
| 490867 | 2/1953 | Canada | 46/38 |
| 6682 | of 1915 | United Kingdom | 220/260 |

*Primary Examiner*—F. Barry Shay

*Attorney, Agent, or Firm*—Nilsson, Robbins, Dalgarn, Berliner, Carson & Wurst

[57] ABSTRACT

A pinata for containing a plurality of small items in a substantially enclosed cavity formed by first and second walls. The first and second walls are held in an assembled relationship by a line having one end attached to a pull-pin located in the second wall, the line and pull-pin maintaining the first wall in a fixed relationship to the second wall. The pull-pin has attached to one end a pull-line which is concealed among a plurality of decorative ribbons or strings extending downwardly from the pinata. Pulling on the pull-line dislodges the pin thereby releasing the first wall of the pinata and allowing small items contained within the cavity to drop to the floor.

15 Claims, 6 Drawing Figures

PULL-PIN PINATA

RELATED APPLICATION

This application is a continuation-in-part of my application Ser. No. 758,215, filed Jan. 10, 1977, now U.S. Pat. No. 4,092,798 entitled "Balloon Pinata," which in turn is a continuation-in-part of my application Ser. No. 617,602, filed Sept. 29, 1975 entitled "Break-Away Pinata," now U.S. Pat. No. 4,015,364.

FIELD OF THE INVENTION

The field of art to which the invention pertains includes the field of containers, specifically pinatas.

BACKGROUND AND SUMMARY OF THE INVENTION

Pinata breaking celebrations are quite popular in Mexico and in the Mexican communities of the Southwestern United States. Pinatas are traditionally a pot or container ornamented with colorful paper and filled with candy, nuts confetti and/or token gifts such as small toys and the like. The pinata is suspended above a party area and at the appropriate time and with celebration it is broken so that the treats are scattered among the guests who in turn can keep whatever they collect. The usual method of breaking the pinata is by beating it with a club or cane and this is either done by a blindfolded child who is the subject of the celebration or by several children in succession, each given a certain number of turns in which to break the pinata. Unfortunately, as a result of the enthusiasm of the guests in gathering close to the pinata so as to obtain a large number of candies or gifts, it occasionally happens that a child is hit by a club or cane. Additionally, the traditional pinata is made of clay pottery and large falling fragments can cause injury to a young child. Modern pinatas are often made of paper-mache, avoiding the dangers of cracked clay fragments, but such pinatas are generally more difficult to break, requiring greater swings with the resultant danger from that aspect to the children. In my prior application Ser. No. 617,602, I provide a pinata having a bottom surface formed with at least one line of weakness so that it will break away upon successive pulls or jerks on a suspension line. In my prior application Ser. No. 758,215, I provide a pinata which collapses upon puncturing of a balloon. Such pinatas require replacement of at least one component for each pinata use.

The present invention provides a pinata which is completely resuable. The pinata is formed of walls that define a substantially enclosed chamber for containment of candies and favors including a first wall and a second wall cooperating with the first wall. Means are provided for suspending the pinata and holding the first wall in assembled relationship with, but free of direct attachment to, the second wall. The suspending and holding means can be released so that the first wall can be displaced with respect to the second wall thereby releasing the candies and favors.

In a first embodiment, a tiered, cylindrically-shaped pinata is vertically divided into two equal sections, one section defining the first wall and the other section defining the second wall. A suspension line supports the second wall and a holding line dependent from the suspension line extends through openings in the top and bottom surfaces of the first wall to a holding pin positioned in an opening in the bottom surface of the second wall. Dependent from the holding pin is a pull-line which is concealed within a plurality of similar decorative strings or ribbons extending downwardly from the pinata bottom surface. Removal of the pull-pin from the second wall allows the first wall to drop vertically with respect to the second wall thereby providing an opening through which the candies and favors can fall.

A further embodiment of the invention consists of a tiered, cylindrically-shaped shell open at the bottom defining the first wall and a laterally extending bottom surface defining the second wall. In this embodiment, a suspension line terminates in a loop and extends through an opening in the top of the first wall and into a protrusion extending upwardly from the inner surface of the second wall. The protrusion has a laterally extending bore for containment of a pull-pin. When the pinata is assembled, the pull-pin is positioned in the laterally extending bore and through the suspension line loop. The first wall rests upon and is supported by the second wall which is frictionally lodged therein. The pull-pin is connected to a pull line which is similarly concealed among a plurality of similar decorative strings or ribbons depending downwardly from the bottom perimeter of the first wall. Pulling of the pull-pin releases the second wall and then impacts against the bottom wall to dislodge it, allowing the candies and favors to fall to the ground. In broader terms, though less desirable, the embodiment can be practiced, and therefore encompasses, by omitting the pull pin and instead providing a knot at the inner end of the string or ribbon (or other impact means) to impact against the bottom wall. In this latter version, the pinata would simply be suspended from the top.

DETAILED DESCRIPTION

As required, detailed illustrative embodiments of the invention are disclosed herein. These embodiments exemplify the invention and are currently considered to be the best embodiments for such purposes. However, it is to be recognized that other pinata configurations could be utilized to implement the principles of the invention. Accordingly, the specific pinatas disclosed are representative in providing a basis for the claims which define the scope of the present invention.

A pinata according to the present invention has a first wall and a second wall cooperating with the first wall so that when in an assembled relationship they form a substantially enclosed chamber for containing candies, toys, or the like. A means for suspending the pinata and for holding the first wall and the second wall in an assembled relationship is provided. The invention also provides means for releasing the suspending and holding means so that the first wall is displaced relative to the second wall thereby causing the items contained within the chamber to be released. Two embodiments of the invention are disclosed, the first embodiment having the first wall and second walls comprising vertically extending pinata halves and a further embodiment comprising side and top wall portions defining a first wall and a horizontally extending bottom portion defining a second wall.

Figure 1:
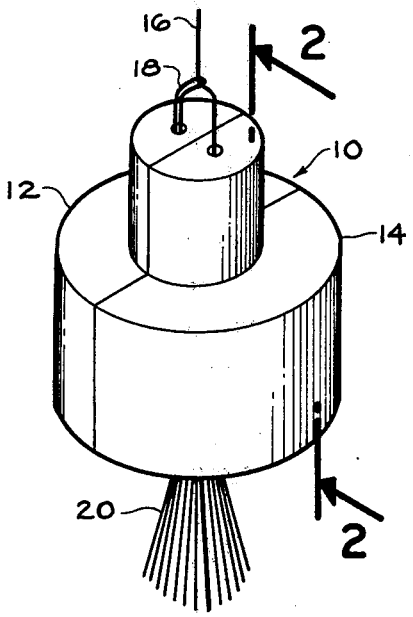
FIG. 1 is a perspective view showing an assembled pinata according to a first embodiment of the invention.

Referring to FIG. 1, a pinata 10 is provided having a first wall 12, a second wall 14, a suspension line 16, a holding line 18 dependent from the suspension line 16, and a plurality of downwardly extending decorative ribbons 20. The first wall 12 and second wall 14 are substantially identical in contour and each comprise one half of the vertically divided pinata 10.

Figure 2:
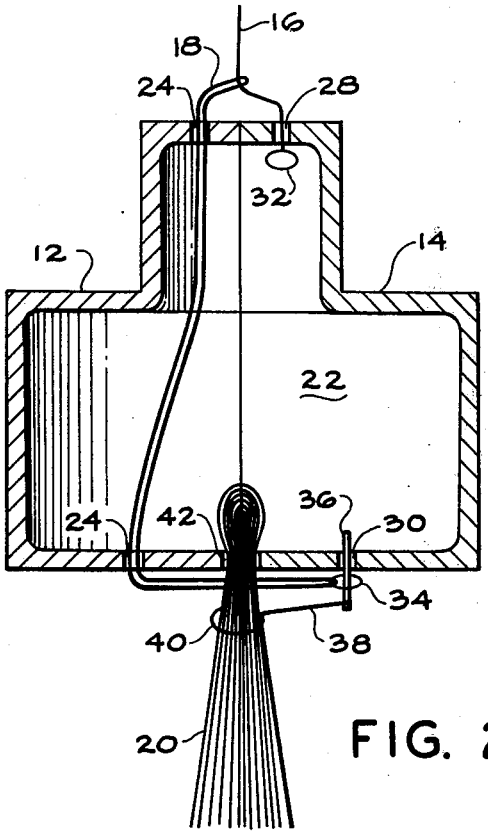
FIG. 2 is a cross-sectional view taken along line 2—2 of FIG. 1 showing the two pinata halves in an assembled relationship.

Details of the assembled pinata 10 can be seen in the cross-sectional view of FIG. 2. The pinata walls 12 and 14 when assembled define a chamber 22 for containing small candies and favors. The pinata walls 12 and 14 can be formed of any suitable material such as rigid, foamed polystyrene. The first wall 12 has a small hole 24 formed in its upper surface and a similar hole 26 formed in its lower surface. In a similar and symmetrical manner, the second wall 14 has an upper surface hole 28 and a lower surface hole 30. The suspension line 16 extends through the second wall upper hole 28 and has a button 32 tied to its end, the button having a diameter larger than the hole 28 diameter. The button 32 prevents the suspension line 16 from pulling through the upper hole 28 and provides hanging support for the second wall 14. A looped holding line 18 is dependent from the suspension line 16 and extends through the first wall upper hole 24 and the first wall lower hole 26. Its lower end is attached to a ring 34 having a diameter larger than that of the first wall lower aperture 26. A pull-pin 36 serves as a removable support member and is fitted upwardly through the ring 34 and slidably engaged by the second wall lower hole 30. Dependent from the pull-pin 36 lower end is a pull-line 38 which is guided to and disposed within the decorative ribbons 20 by a rubber band 40. The length of the pull-line 38 is adjusted so that when disposed within the decorative ribbons 20 it will be indistinguishable. The first wall 12 and second wall 14 define through their bottom surfaces a string holding aperture 42 through which the decorative strings 20 are looped and removably secured.

Figure 3:
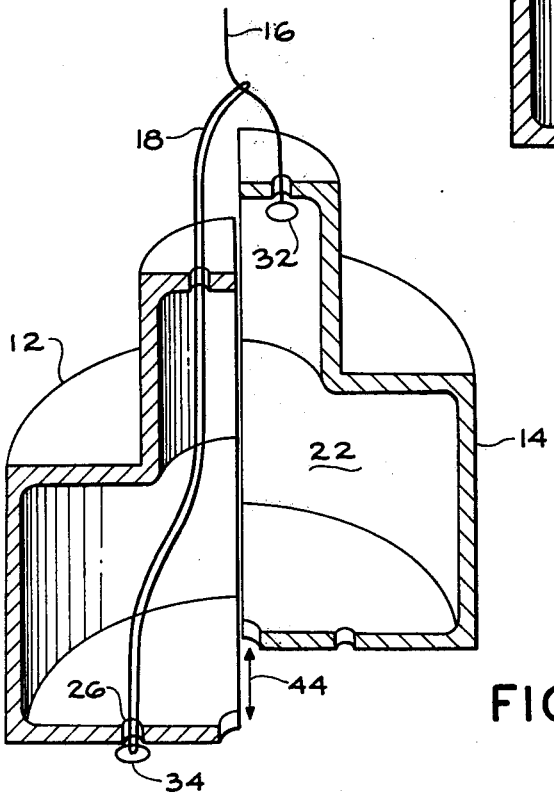
FIG. 3 is a cross-sectional perspective view of the two pinata halves subsequent to removal of the pull-pin.

In operation, the players selectively pull a string from the decorative ribbon bundle 20. A player at the initiation of each pull will be unsure as to whether he is pulling one of the decorative ribbons 20 or the pull-line 38. Eventually the pull-line 38 will be pulled thereby removing the pull-pin 36 from the second wall lower aperture 30 and relasing the ring 34. The first wall 12 and second wall 14 will then assume a relationship respecting each other as shown in FIG. 3. As can be seen, subsequent to removal of the pull pin 36, the first wall 12 will drop respective the second wall 14 until retained by the ring 34 which is unable to slip through the first wall lower aperture 26. The first wall 12 is then retained by the holding line 18 which remains dependent from the suspension line 16. The candies and favors contained within the chamber 22 will fall through the thus created opening represented at 44.

Figure 4:
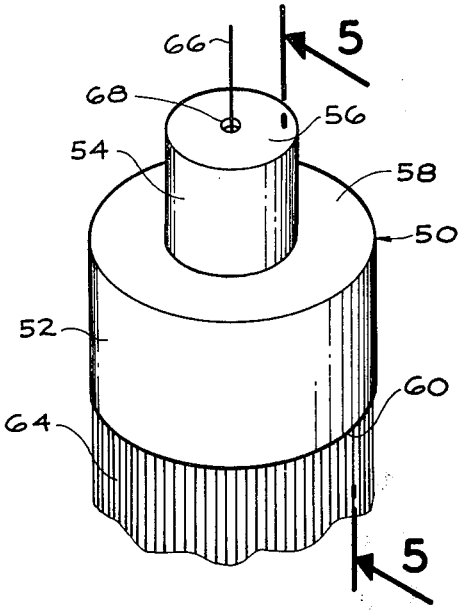
FIG. 4 is a perspective view of a pinata according to a further embodiment of the present invention.

Referring to FIG. 4, a further embodiment of the invention is disclosed having a first wall 50 defining a layer of stacked, cylindrical side walls 52 and 54 and concentric top walls 56 and 58. A second wall 60 defines a bottom wall having an extended surface which closes with the lowermost cylindrical side wall 52 bottom edge so that a chamber (62 in FIG. 5) is attained by cooperation of the first wall 50 and the second or bottom wall 60. A plurality of decorative ribbons 64 depend from the perimeter of the bottom wall 60. A suspension line 66 extends through a small opening 68 provided in the center of the uppermost concentric top wall 56.

Figure 5:
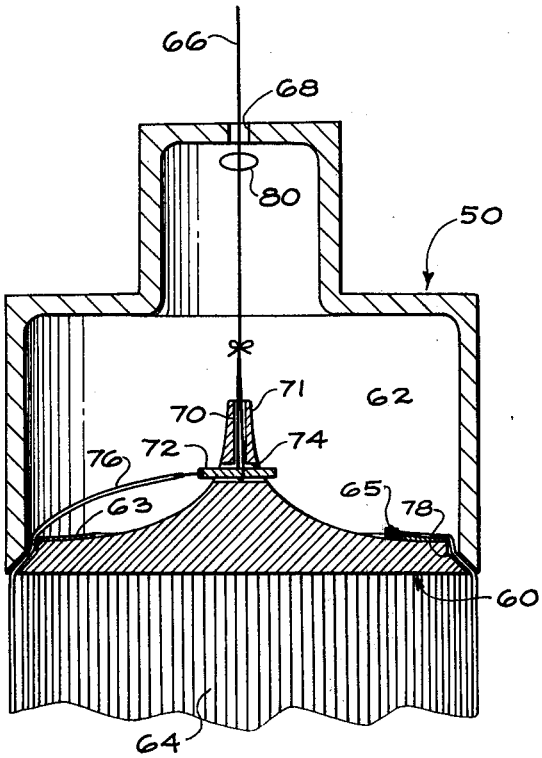
FIG. 5 is a cross-sectional view taken along line 5—5 of FIG. 4 showing the relationship of the top and side walls to the bottom when in an assembled relationship.

Referring additionally to FIG. 5, the suspension line 66 is threaded through the uppermost top wall opening 68 and through a vertical hole or bore 70 formed in the center of a cone-shaped protrusion 71 extending upwardly from the interior surface of the bottom wall 60. A pull-pin 72 serves as a removable support member and is positioned within a horizontally extending bore 74 which intersects the vertically extending bore 70 and is disposed through a loop provided in the lower end of the suspension line 66. The pull-pin is attached to a pull-line 76 which extends outwardly to the edge of the bottom wall 60 and is concealed within the decorative ribbon array 64. It is important that the length of the pull-line 76, also a ribbon, be chosen so as to be compatible with the length and appearance of the decorative ribbons 64 thereby making the pull-line indistinguishable therefrom. In an assembled condition as shown in FIG. 5, one can appreciate that the first wall 50 is supported by the bottom wall 60 at the perimeter of the bottom wall and that the bottom wall 60 is frictionally lodged within the first wall 50. The bottom wall edge is chamfered inwardly as shown in FIG. 5 at 78 and interfaces with a corresponding chamfer formed inwardly on the first wall 50 lower perimeter, but continues upwardly with a shoulder that frictionally secures the bottom wall 60 to the first wall 50. Stop means are provided to retain the portion of the suspension line 66 within the cavity 62 to prevent the first wall 50 from dropping to the floor subsequent to removal of the bottom wall 60. Although this stoppage means could take many forms, the embodiment disclosed herein utilizes a button 80 having a diameter larger than the diameter of the opening 68 in uppermost top wall 56. The decorative ribbons 64 can be attached to the lower perimeter of the first wall 50 by a suitable adhesive. Alternatively, as illustrated, one could place within the chamber 62 a circular cardboard ring 63 having the decorative ribbons 64 removably secured by clips 65 so as to be dependent therefrom and having a diameter slightly smaller than the diameter of the bottom wall.

Figure 6:
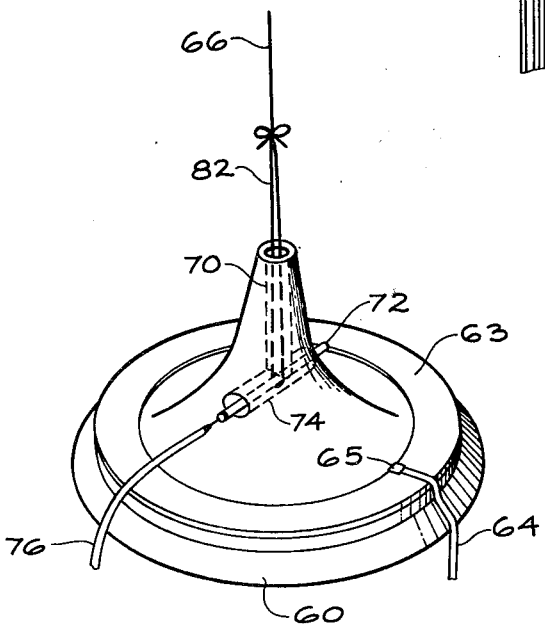
FIG. 6 is a perspective view of the bottom wall surface showing the relationship between the pull-pin and suspension line when the pinata is in an assembled relationship.

Referring additionally to FIG. 6, constructional details of the bottom wall can be further appreciated. The suspension line 66 is terminated in a loop 82 which extends downwardly into the vertical extending bore 70. The horizontally extending bore 74 is formed so as to intersect the vertically extending bore 70. The pull-pin 72 is fitted within the horizontally extending bore 74 and is positioned so that it is disposed through the suspension line loop 82. Thus, it can be appreciated, as long as the pull pin 72 is disposed within the bore 74 and through the loop 80, the pinata will remain in an assembled configuration with the weight of the first wall 50 distributed around the chamfered perimeter of the bottom wall 60.

In operation, removal of the pull-pin 72 as a result of a downward force applied on the pull line 76 will release the suspension line loop 82 from the pull-pin 74 thereby allowing the bottom wall 60 to fall away when it is impacted by the pull-pin 72. The first wall 50 will then drop until retained by the button 80. As one can appreciate, the bottom wall will usually not be damaged during the pin pulling process and the entire pinata assembly can be reused without replacing any of the components.

It will be appreciated that the pinata can be constructed so that frictional forces along retain the bottom wall. In such case the pull-pin can be replaced with any simple impact means such as a simple knot at the inner end of the pull line 76.

I claim:

1. A pinata, comprising:

walls defining a substantially enclosed chamber whereby a plurality of small items may be carried in said chamber, comprising a first wall and a second wall cooperating with said first wall;

means for suspending said pinata, and for holding said first wall in releasable assembled relation with said second wall; and a plurality of lines extending from said pinata when it is suspended, said lines including means for displacing said means whereby said first wall is held relative to said second wall, thereby allowing separation of said walls and releasing said plurality of small items.

2. The pinata of claim 1 in which said first wall defines top and side wall surfaces and said second wall defines a bottom wall having an extended surface, and wherein:

said suspending and holding means comprises a looped suspension line extending through an opening in said top wall surface; and said displacing means comprises a removable support member which, when inserted through said suspension line loop, holds said second wall in assembled relationship to said first wall.

3. The pinata of claim 2 wherein:

said second wall inner surface forms an upwardly extending protrusion having a centrally located, vertically extending bore formed therein and which intersects a horizontally extending bore in said protrusion; and said removable support member comprising a pull-pin for positioning in said horizontally extending bore and extending through said suspension line loop, said suspension line loop being disposed within said vertically extending bore.

4. The pinata of claim 3 in which said pin is connected to a pull line dependent from said second wall edge and constituting said displacing means.

5. The pinata of claim 4 in which said plurality of lines comprises decoy lines of like construction as said pull line and extending downwardly a like distance from said second wall edge whereby to disguise the identity of said pull line.

6. The pinata of claim 5 further comprising stop means attached to a portion of said suspension line within said pinata chamber for retaining said first wall on said suspension line after said pull-pin is removed from said horizontally extending bore.

7. The pinata of claim 6 wherein said stop means comprises a button attached to said suspension line.

8. The pinata of claim 1 having top, side and bottom surfaces, said pinata being vertically divided into a first part defining said first wall and a second part defining said second wall.

9. The pinata of claim 8 in which said suspension and holding means comprises:

a suspension line extending through an opening in the top surface of said second wall, said suspension line end attached to a stop means whereby to prevent said suspension line from pulling through said opening; and a holding line dependent from said suspension line, said holding line extending through openings in said first wall top and bottom surfaces and attached to said second wall.

10. The pinata of claim 9 in which said suspension and holding means comprises a pull-pin disposed in an opening in said second wall bottom surface.

11. The pinata of claim 10 in which said plurality of lines comprises downwardly extending decoy lines of like construction as said pull line dependent from a centrally disposed opening defined in said first and second wall bottom surfaces; and means for disposing said pull-line among said plurality of decoy lines.

12. The pinata of claim 11 in which said disposing means comprises a rubber band around said pull line and said decoy lines.

13. The pinata of claim 9 in which said holding line end is attached to said releasing means through a stop means for preventing said holding line end from passing through said opening in said first wall bottom surface thereby supporting said first wall after removal of said releasing means.

14. The pinata of claim 1 formed of rigid, foamed polystyrene.

15. The pinata of claim 1 in which said displacing means comprises a knot at the inner end of one of said lines.

* * * * *